US005901589A

United States Patent [19]

Cordero

[11] Patent Number: 5,901,589

[45] Date of Patent: May 11, 1999

[54] QUICK OPENING HAND GUN SAFE

[76] Inventor: Carlos T. Cordero, 2615 Hershfield Ct., Silver Spring, Md. 20904

[21] Appl. No.: 08/988,694

[22] Filed: Dec. 11, 1997

[51] Int. Cl.[6] ..... E05B 65/52

[52] U.S. Cl. ..... 70/63; 109/59 R

[58] Field of Search ..... 70/63; 109/50–53, 109/59 R, 69, 45, 47; 220/210; 206/1.5, 317

[56] References Cited

U.S. PATENT DOCUMENTS

| | | | |
|---|---|---|---|
| 4,615,281 | 10/1986 | Gaston | 109/59 R X |
| 4,768,021 | 8/1988 | Ferraro | 109/38 X |
| 4,800,822 | 1/1989 | Adkins | 109/59 R |
| 4,852,503 | 8/1989 | Lichter | 109/59 R |
| 4,890,466 | 1/1990 | Cislo | 70/63 |
| 5,056,342 | 10/1991 | Prinz | 70/63 |
| 5,111,755 | 5/1992 | Rouse | 109/59 R |
| 5,172,575 | 12/1992 | Fisher | 70/63 |
| 5,189,894 | 3/1993 | Buck | 70/63 |
| 5,329,865 | 7/1994 | McWard | 109/59 R X |
| 5,344,010 | 9/1994 | Dyer et all. | 70/63 X |
| 5,566,828 | 10/1996 | Claes et al. | 70/63 X |
| 5,662,219 | 9/1997 | Tschudy et al. | 70/63 X |

*Primary Examiner*—Suzanne Dino Barrett
*Attorney, Agent, or Firm*—Laurence R. Brown

[57] ABSTRACT

A storage safe is especially adapted for storage of hand guns having a substantially parallelepiped shaped exterior body and internal compartment for holding a hand gun in position for grasping ready to fire. Fast access to the gun under emergency conditions is provided by a novel internal spring biased latching mechanism locking the access door closed. The safe may be immediately opened by operating a hidden unlatching trigger from outside the safe and opening the door in an unconventional manner.

14 Claims, 3 Drawing Sheets

QUICK OPENING HAND GUN SAFE

TECHNICAL FIELD

This invention relates to safes, and more particularly it relates to safes for storing hand guns.

BACKGROUND ART

It is imperative to keep hand guns out of the hands of children and thieves. The art does supply somewhat conventional small safes for locking up hand guns. Most of such safes are small portable safes, which may be easily carried off by thieves. Also they are not easily disguised or proportioned to be hidable to reduce the possible discovery of their location and access thereinto by either a curious child or potential thief.

Some of these safes have combination locks, which in particular are quite unsatisfactory in that the guns cannot be quickly withdrawn because of the time for manipulation and the need for visibility which makes night-time entry difficult. Thus, in the event of danger such as the encountering of a burglar at night, it is difficult to retrieve a hand gun quickly without making noises or turning on lights. Under such times of stress, not only is fast action necessary, but a routine for removal of the hand gun into a ready to use posture is necessary which is not apt to be aborted by the need to access the safe quietly and rapidly, or simply because of nerves in the excitement of the moment that makes a combination inoperable. With the operation of a combination lock necessary, for example, an aborted attempt to open the safe to retrieve a hand gun could end up as a fatality because the combination was not handy or because in the excitement and need for fast action the combination was muffed or the unlocking process was noisy or required turning on a light.

Similar problems are encountered with key operated safes. To find the key in times of stress in the presence of a middle-of-the-night intruder, for example, you cannot turn on a light to search for the key hidden in a drawer which could not be opened without possibility of a tell-tale noise, or a possibility of stumbling over an object trying to get to the key hiding place, thus being apt to make noises in the attempt that would alert a burglar.

It would be desirable therefore to have a hand gun safe that would permit a loaded hand gun to be stored in a position available for immediate use and preferably a safe of a size that could easily be secreted so that it would be hard to locate.

In the case of storing a hand gun in a household with minor children, special precautions must be made to keep that gun secretly stored and if found, still inaccessible to the children because the safe is child-proof enough that it could not be easily opened. Also the ability to hide the safe and its contents from potential theft is important.

Even with these pressing demands for better solutions, no known safes have been introduced which would satisfy the aforesaid safety and access conditions and avoid the problems. Gun safes in the prior art are typically small safes which are made and locked in a conventional way and depend upon keys or combinations for preventing access to a gun. Thus, there is a special need for a satisfactory improved and innovative hand gun safe.

A general objective of this invention is to provide an improved safe for storage of a hand gun.

A more specific objective of this invention is to provide a fast access, childproof safe especially adapted for storing a hand gun. Another objective of the invention is to provide a safe for storage of a hand gun that affords the desired advantages above discussed and solves the prior art problems above set forth.

Other objects, advantages and features of the invention will be found throughout the following description.

DISCLOSURE OF THE INVENTION

A specially designed hand gun storage safe is especially adapted for immediate retrieval of a stored hand gun ready to use. An internal compartment holds the hand gun in ready position for grasping ready for immediate firing, when the safe is locked in an access mode. Consequently, the safe may be locked by conventional locking means in a super safety mode for those without a key or combination to obtain access.

Thus, the safe has an access door, which is normally latched in closed position in the access mode by an internal latching mechanism, when the conventional locking mechanism is not locked. This internal latching mechanism has a spring operated closure latch and a hidden internally-mounted-inside-the-safe unlatching means. An external trigger operable from outside the safe for opening the access door is disguised as is the unconventional opening mode of the door so that the safe appears to be locked in closed position to be inaccessible without a key or combination in the access mode. Thus, both the hidden trigger mechanism and the unconventional opening mode must be discovered to gain access to the hand gun stores inside the safe, which in essence makes it "child proof" and burglar resistant, without making it inaccessible for retrieving the hand gun as a matter of practical behavior to an adult in times of emergency, such as when a night-time prowler is heard in the house.

Advertisements for the safe should not disclose how it is opened. It is suggested that the purchaser install the safe when alone in the home or office, and that only those persons who may use the hidden gun know where it is and how the safe opens.

The mechanism details, a preferred embodiment of the invention and a recitation of other objectives, advantages and features of the invention will be found throughout the remaining description and accompanying drawings.

BRIEF DESCRIPTION OF THE DRAWINGS

In the drawings, wherein like reference characters refer to similar features throughout the several views.

THE PREFERRED EMBODIMENT

Figure 1:
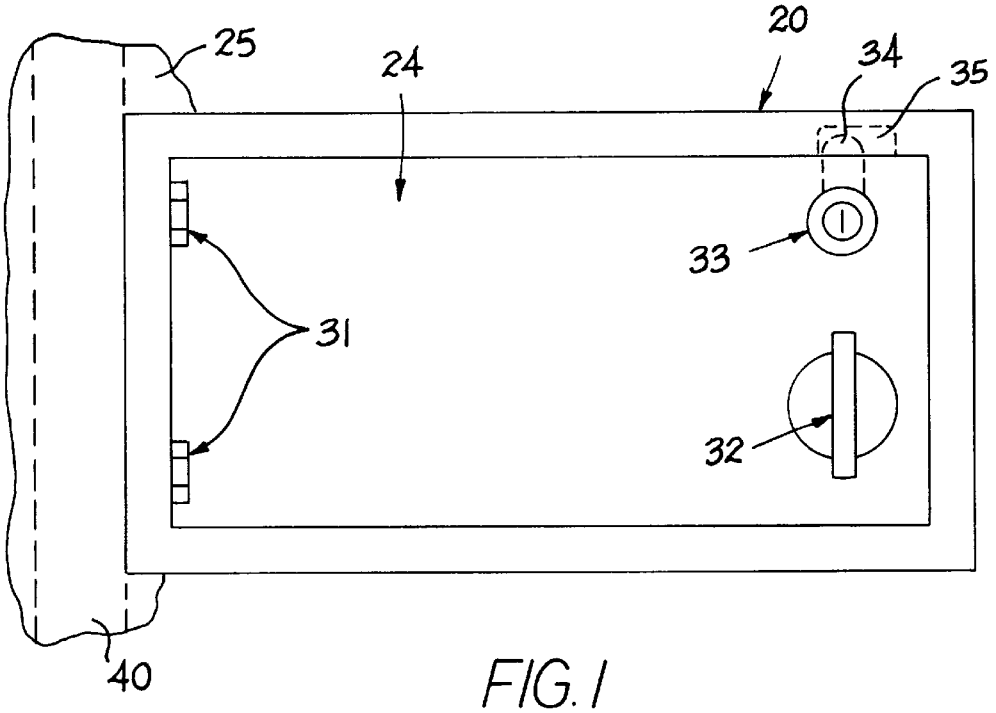
FIG. 1 is a fragmental front view sketch of the front panel of a gun safe afforded by this invention flush mounted in a wall and held between two vertical studs.
Figure 2:
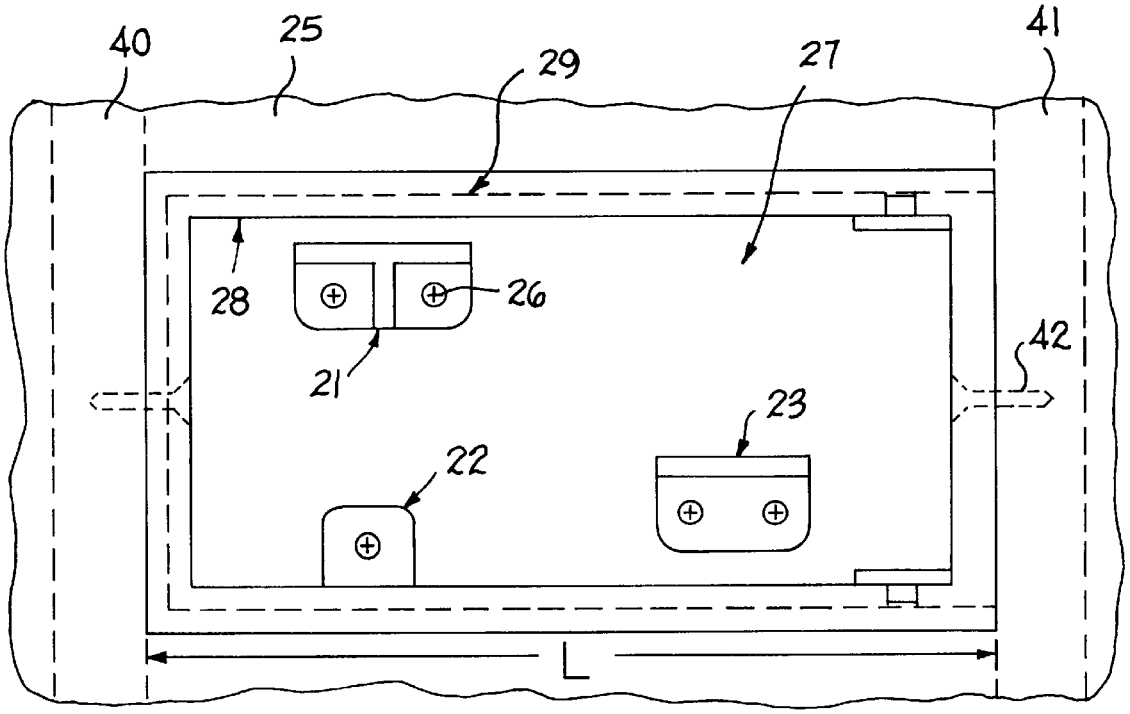
FIG. 2 is a fragmental view sketch of the installed gun safe with the cover removed for viewing the inside gun storage compartment.
Figure 3:
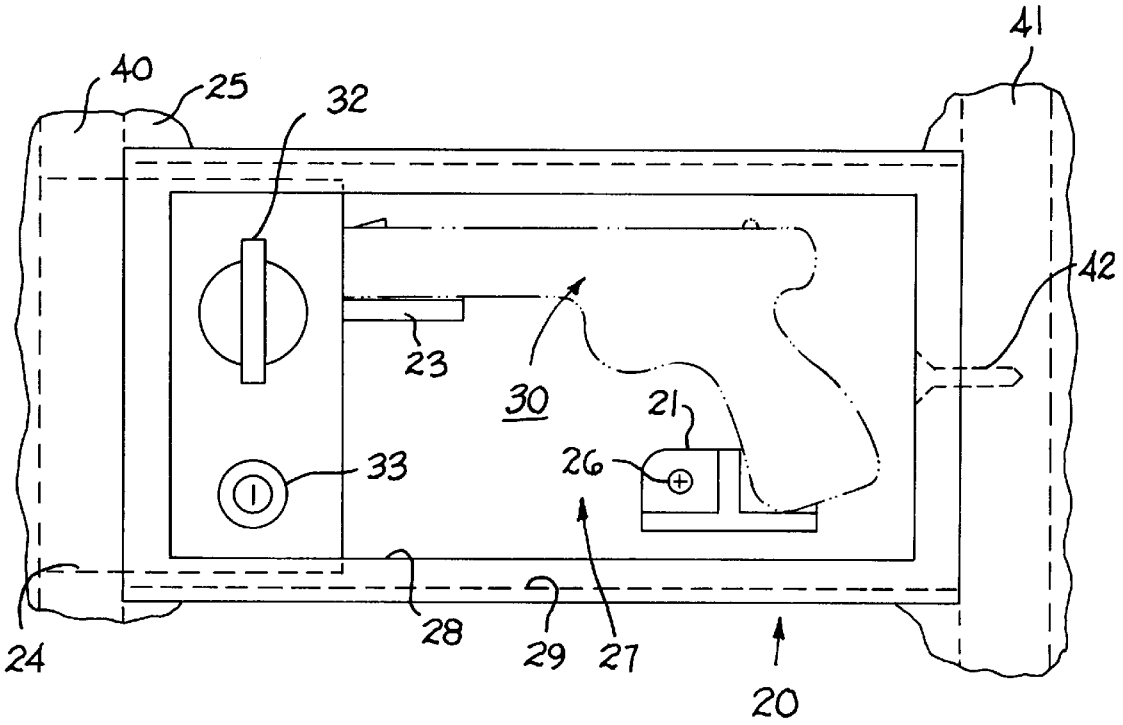
FIG. 3 is a front view sketch of an installed gun safe embodiment with an open access door, showing a stored hand gun in place on the inner rack mount blocks and positioned to grasp in a ready-to-fire position.

Now with reference to FIGS. 1 and 2, the gun safe 20, preferably having an elongated parallelepiped outer configuration with an inner substantially parallelepiped storage compartment 27, is configured with gun supporting racks 21, 22, 23 for lodging a hand gun 30 in a position for removal through an opened access door 24, as shown in FIG. 3, for example. The supplied shown gun racks are mounted on the bottom of the storage compartment 27 by screws 26 and may be of various shapes at various locations to hold hand guns of various styles and shapes in a readily accessible position to grasp. For this purpose the mounting blocks or brackets 21, 22, 23 are arranged to hold the gun 30 a short distance away from the back safe wall on the bottom of the open compartment 27 to facilitate grasping the gun. The blocks, as shown are supplied or may be custom configured by shape and placement to hold a particular gun in a position so that either a right handed or left handed person by reversing installation may grasp the gun handle and withdraw the gun in a ready position for immediate firing, if necessary.

The access door 24 slides laterally behind the wallboard 25 into the open access position as shown in FIG. 3. This provides an opening for a hand to enter and grasp the gun handle in a ready to use posture. The illustrated embodiment has the door panel sliding to the left. The gun here may be grasped by either left handers, or right handers. The door slides to the right or left until stopped by the handle 32. The gun 30 is arrayed in gun racks 21, 22, 23 for easy access. For better right handed access, the handle would preferably be on the right hand side.

The access door 24 is substantially a rectangular panel of predetermined thickness, recessed slightly from the front surface of the wallboard 25 and slidably movable laterally in a groove 29 located internally behind the outer rim 28, which is mounted flush with the outer surface of the wallboard 25.

The illustrated accessories mounted on the door 24 include a set of fake hinges 31, a slightly protruding handle 32, which also serves as a limiting stop member when the door opens, and a conventional lock 33. The lock 33 in this embodiment is a key operated latch, which in the shown locked position has the rotatable lever 34 moved into a stop formed by internal slot 35 so that the door panel 24 may not be moved to the left into its open position. Of course, a combination lock may be substituted if desired or other locking variations may be employed. In the unlocked position, which defines an access mode of operation, this safe provides instantaneous entry for use in emergencies. In a maximum or super safety mode of operation with the lock actuated, additionally an entry key or combination must be available for access. Thus, even if a key is found, the safe still will be inaccessible without knowing that the door 24 must slide laterally and the secret process of finding a hidden access trigger mechanism to release the door into a sliding mode.

With the fake hinges 31, and the visible lock 33 arranged on the access door panel, the operating mode of the safe is camoflauged, since the safe front panel appears to be a conventional hinged door which is locked in its closed position thus deterring the possibility of children or thieves gaining access without destructive action. Note that both the sliding mode of the panel door 25 and a hidden trigger mechanism for opening it, which is later discussed, must be discovered to open the safe, so that a compound discovery must be made to gain access to a stored gun even if a key or combination is found.

The preferred elongated parallelepiped safe 24 configuration is adapted to have the longest dimension L of exactly fourteen and three-eights inches, thus to snugly fit between two standardly spaced (16 inch center) two by four studs 40, 41, located in a wall where the safe may be installed, for example by screws 42 entering the studs. Of course, filling shims or lengthening notches in studs may be used to assure a firm, snug fit, if necessary. The depth is consistent with fitting into the 2×4 studs between opposite front and back sidewalls 25. The height is enough for comfortably lodging a hand gun, typically six to eight inches. If not installed in a wall, the safe alternatively can be stored in a drawer or closet shelf for example.

Figure 4:
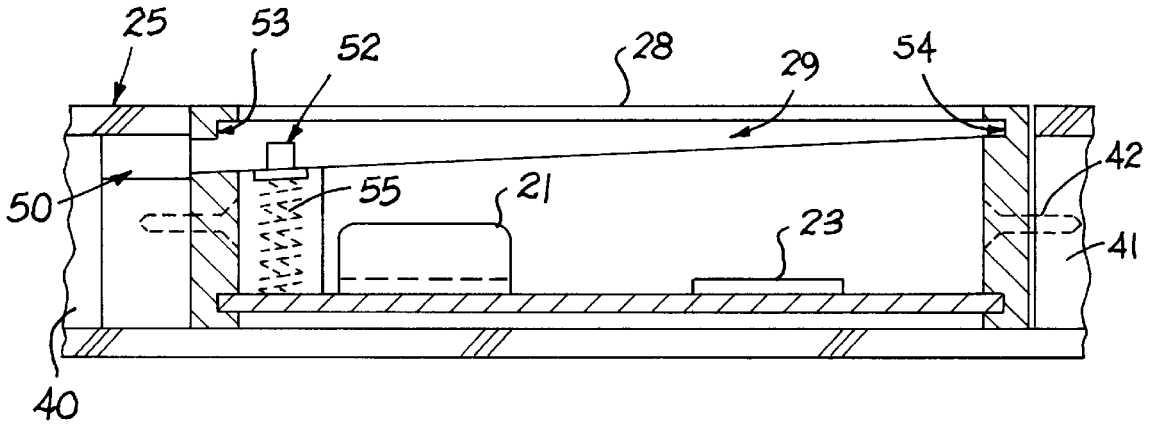
FIG. 4 is a section view of the gun safe, with the access door removed, looking downwardly into the mounted position in a wall between two studs.

The internal structure for triggering and sliding the door to its open position is best seen from FIGS. 3 and 4. This mounting arrangement by means of the triggers 52 and springs 55 arranged on opposite sides of the internal cavity 27 at the fake hinge end of the door panel 24, spring biases the access door panel 24 upwardly as shown in FIG. 4 to be snugly and immovably confined within the grooves 29 indented in the four sidewalls of the gun safe 20 to abut the end wall stops 53, 54 for preventing lateral movement as well as corresponding side wall stops constituting the outer walls of sidewall grooves 29. This position of the door access panel 27 prohibits any lateral movement of the access door.

Figure 6:
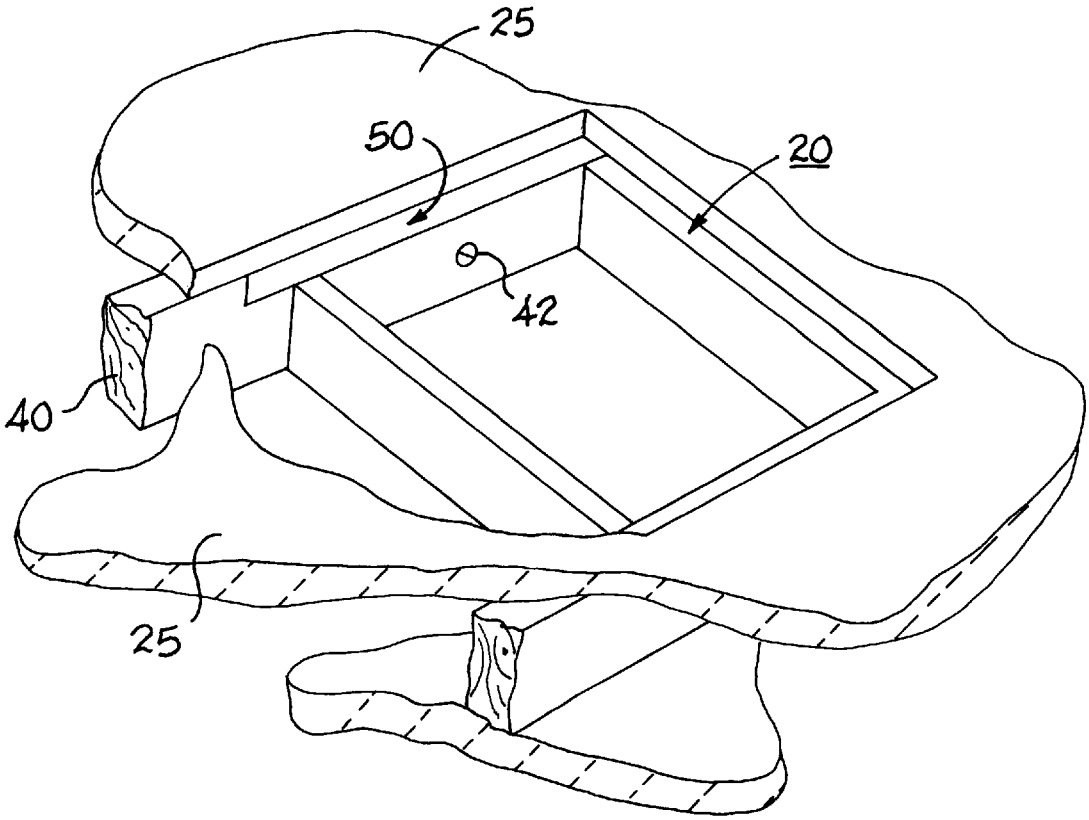
FIG. 6 is a perspective fragmental view of a cut away wall installation site for the gun safe between two studs, showing how to install the access door for lateral movement behind the wall by passing through a slot in one of the studs.

However, note that the slot 29 converges toward the hinge end of the door panel to mate with the underlying slot 50 formed in the face of stud 40 (as better visualized from FIG. 6). Thus, if the door panel laterally slides on the slanting lower groove surface it passes through the slot 50 to the position shown in FIG. 3 when the spring 53 loaded triggers 52, mounted on opposite sides of the inner compartment, are compressed by firm pressure on the outside surface of the door panel 24 at the hinge end to lower the hinge end of the door panel 27 out of the laterally immovably confined normal position. The pressure on the hinge end of the door panel 27 must be equally dispersed across the hinge end to release triggers 52 on both sides of the compartment before the door panel can slide through the slot 50 in stud 40 to extend the hinge end behind the mounting wall 25. Preferably the trigger 52 is adapted to let the door slide with little friction, and could for example have a slippery surface or roller in contact with the inside surface of the door panel 24. Thus, the hidden trigger mechanism is secret and unobvious, and is not apt to be known or decipherable by children. Preferably stiff springs 55 are used that would be hard for children to overcome.

It is thus, evident that this invention provides a gun safe that is secure, yet which provides immediate access to the gun should an emergency so require. The access, when the access sequence, the laterally sliding door mode of access and the hidden trigger mechanism operation is known, is simple enough that even under emergency conditions the gun can be retrieved noiselessly and immediately ready for action, without complications that could forwarn a night time intruder for example. The lock 33 mounted on the door panel with access from the outside provides an alternative super safety mode of access since it is operable either to selectively prevent the door panel from being pushed inwardly to slide through said slot, or to retain the hinge end of the panels locked in place, thus preventing the door panel 24 from being lowered to laterally slide out of its normal immovable position.

The gun 50 is positioned in FIG. 3 for left handed access when the sliding access door 27 is opened to the right. Conversely, the gun handle would be oriented to the left for right handed users with the door sliding to the right and by rearranging the mounts 21, 22, 23. The stop member 32 on the handle will abut with the rim 28, thus serving to retain the door panel so that it can be opened, but cannot be pushed behind the wall through slot 50 and be lost. The mounts 21, 23 keep the gun handle off the compartment 27 bottom for facilitating grasping, and may be shaped and positioned for guns of different shapes and styles.

The hatching for the safe walls is shown of metal in FIG. 4, but it also may be made of wood or plastic for example. It is within the skill of the art to adopt whatever manufacturing methods that are conventional and desirable to provide equivalent constructional details for providing the features of this invention.

Figure 5:
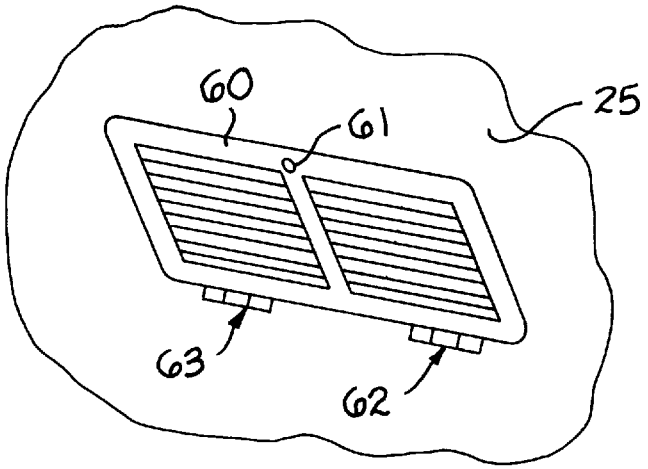
FIG. 5 is a perspective view of a gun safe site in a wall behind a camouflage register plate.

It is seen in FIG. 5 that the wall mounted gun safe of this invention may be hidden behind a fake register outlet 60 for example that easily opens when a trigger button 61 is pressed and the register 60 is rotated downwardly about hinges 62, 63. Or alternately the safe may be hidden behind a picture on the wall.

The broken away, fragmental, perspective view of FIG. 6 shows more clearly how simply the wall mount is achieved. Thus, it is seen that the slot 50 may be simply made through the stud 40, behind the wall 25 before entry of the safe 20. Thus, to install a simple rectangular shaped safe 20, a section of wall 25 may be removed, the slot 50 cut into the stud with a hand drill or routing tool, the safe inserted into the wall cavity and the screws 42 may be inserted into the stud by a portable battery powered screw driver with the door 20 (not shown) in its open position, partially extending through the slot 50 in the stud 40 as shown in FIG. 3.

The view of FIG. 6 also clarifies the feature of this invention that the novel gun safe may be made in a parallelepiped body shape that is also useful in portable form for storage on a closet shelf, for example, and that such a gun safe still provides the rapid access feature together with the security against unwarranted access that this invention provides.

It is therefore seen that the gun safe provided by this invention may be used either permanently mounted in a wall or for storage on a closet shelf, for example, and that it offers security to access by children and thieves without making the gun storage safe complicated and time consuming to access the gun.

The hereinbefore described novel features of this advance in the art are therefore set forth with particularity in the following claims to identify the nature and spirit of this invention.

I claim:

1. A safe for storage of a hand gun, comprising in combination:

a substantially parallelepiped gun storage body being adapted with a hollow interior compartment for retaining a hand gun in a position for removal through an access door thereinto in the grasp of a hand in a ready to use posture, an access door for said compartment substantially comprising a rectangular panel of predetermined thickness, a mounting arrangement comprising an outer rim about the access door overlying the door panel to constitute therewith an outer closure surface for said body, said outer rim further comprising closure means as a framework confining said door panel substantially laterally in an immovable framing position against said outer rim, opening means comprising interior grooves inside said compartment surrounding the door panel and dimensioned for holding the panel snugly in place behind the outer rim while prohibiting lateral movement of the door panel in a closure mode and for permitting the door panel to move inwardly in an opening mode to escape from the immovable framing position against said outer rim, an opening slot in a side wall of said compartment below said outer rim for mating with said one edge of the door panel in the opening mode, said slot being of a size permitting the door panel to pass laterally therethrough to extend at least partly out of the compartment thus permitting access to said hollow interior cavity, said opening means grooves further being constructed to converge away from said rim inwardly toward said one edge of the door panel adjacent the slot thus providing an inwardly facing ramp for guiding the door panel outwardly through said slot, and wherein said mounting arrangement further comprises spring biassing means for holding the door panel tightly against said framework in said closure mode, said spring biassing means being located near the edge of the door panel adjacent the opening slot so that the door panel may only be opened by pushing inwardly on the slot end of the door panel to overcome the spring bias while sliding the door panel laterally through the slot far enough to provide access for reaching into the compartment and removing the gun.

2. The safe defined in claim 1 further comprising:

locking means mounted on the door panel with manual access from outside the safe body to operate an inner mechanism for selectively preventing the door panel from being moved laterally through said slot.

3. The safe defined in claim 2 further comprising:

a handle on the outer surface of said door panel at the end opposite said slot for assistance in sliding the panel to open said door.

4. The safe defined in claim 2 further comprising:

simulated door hinges arranged in said door panel adjacent the rim at the outwardly disposed end of the door adjacent the slot and opposite to the handle for giving the illusion that the door panel is locked in a closed position.

5. The safe defined in claim 1 further comprising:

a gun mount within said compartment retaining the gun by weight of gravity when said compartment is vertically oriented.

6. The safe defined in claim 1 wherein said door panel is rectangular in shape with the slot adjacent a shorter edge of the panel.

7. The safe defined in claim 1 further comprising, installation means mounting the gun safe body in a wall site to abut two vertically oriented studs with the door panel movable horizontally, wherein a corresponding mating slot is provided in one of the studs for passing the door panel through that stud.

8. The safe defined in claim 1 wherein the gun safe body constitutes a self contained safe body with parallelepiped outer body dimensions and said internal cavity being configured to hold a hand gun in position for a person to grasp a handle of the gun with the access door open.

9. The safe defined in claim 1 further comprising a set of hand gun retaining racks for holding the gun with a handle of the gun in a position away from inner container walls to facilitate grasping.

10. A storage safe having an exterior body and internal compartment for storage of a hand gun comprising in combination:

opening and closing door means mounted in the safe constituting a substantially rectangular closure door panel adapted to slide laterally to pass partly through a slot in a wall of the safe body for creating an access opening, wherein said slot is located inwardly from a closure position of the door panel and the door panel in closure position is retained normally immovably outside the slot with the access opening closed, further comprising, ramp means positioned in safe side walls for moving one lateral end of the door panel inwardly to pass through the slot, and spring biasing means for normally retaining the door panel in its retained normally immovable position, thereby to permit the door panel, when the bias is overcome, to laterally slide following the ramp means to pass partly through said slot, thereby providing an access opening to remove a stored hand gun.

11. The storage safe of claim 10 further comprising a handle, a lock and a set of simulated hinges mounted on the door panel to provide the illusion that the safe is locked when the door panel is in its immovably retained position.

12. A storage safe having an exterior body and internal compartment for storage of a hand gun comprising in combination:

opening and closing door means mounted in the safe constituting a substantially rectangular closure door panel adapted to slide laterally to pass partly through a slot in a wall of the safe body for creating an access opening, and retention means for mounting the safe between two vertically oriented studs in a room sidewall with the door panel parallel to the sidewall and with a mating slot through one of the studs for passing the door panel therethrough when the door panel is moved to create the access opening.

13. A storage safe especially adapted for immediate retrieval of a stored hand gun, comprising in combination:

an internal compartment defined by enclosure wall panels comprising exterior safe walls for holding a hand gun in position for grasping ready to fire, an access door comprising a said enclosure wall panel normally retained laterally immovable in a closed position, a latching mechanism biassed with a closure spring latch holding the access door in closed position, and unlatching means comprising a disguised trigger operable from outside said safe for overcoming the spring latch and moving the door inwardly to a laterally movable position to permit opening of the access door.

14. A storage safe, comprising in combination:

exterior body walls defining an internal compartment for storage of a hand gun, opening and closing door means constituting a substantially rectangular closure door panel comprising an outer wall of the exterior body confined normally in a laterally immovable position, a slot in a wall on the exterior body perpendicular to said door panel comprising an opening through which the door panel is laterally removable when tilted to mate with said slot, and opening means permitting the door panel to tilt into a position to mate with said slot for lateral movement through said access opening to expose said interior compartment and provide access to said hand gun.

* * * * *